US008459962B2

(12) United States Patent
Lee et al.

(10) Patent No.: US 8,459,962 B2
(45) Date of Patent: Jun. 11, 2013

(54) VARIABLE DISPLACEMENT SWASH PLATE TYPE COMPRESSOR

(76) Inventors: Geon-ho Lee, Seongnam-si (KR); Dong-hui Lee, Anseong-si (KR); Tae-jin Lee, Incheon (KR); Ki-beom Kim, Anseong-si (KR)

( * ) Notice: Subject to any disclaimer, the term of this patent is extended or adjusted under 35 U.S.C. 154(b) by 352 days.

(21) Appl. No.: 12/738,745

(22) PCT Filed: Oct. 17, 2008

(86) PCT No.: PCT/KR2008/006140

§ 371 (c)(1),
(2), (4) Date: Apr. 19, 2010

(87) PCT Pub. No.: WO2009/051436

PCT Pub. Date: Apr. 23, 2009

(65) Prior Publication Data

US 2010/0209261 A1 Aug. 19, 2010

(30) Foreign Application Priority Data

Oct. 19, 2007 (KR) ..... 10-2007-0105762

(51) Int. Cl.
*F04B 1/12* (2006.01)
*F04B 27/08* (2006.01)

(52) U.S. Cl.
USPC ..... 417/269; 417/270; 417/271; 92/12.2; 92/13

(58) Field of Classification Search
USPC ..... 417/269, 270, 271; 92/12.2, 13; 91/472, 91/499, 505
See application file for complete search history.

(56) References Cited

U.S. PATENT DOCUMENTS 6,116,145 A * 9/2000 Ota et al. ..... 92/12.2
6,139,282 A * 10/2000 Ota et al. ..... 417/222.2

(Continued)

FOREIGN PATENT DOCUMENTS

DE 11 2008 002 762 8/2010
EP 1111235 6/2001

(Continued)

OTHER PUBLICATIONS

WO 2006 085709.*

(Continued)

*Primary Examiner* — Charles Freay
*Assistant Examiner* — Christopher Bobish
(74) *Attorney, Agent, or Firm* — Ballard Spahr LLP

(57) ABSTRACT

Provided is a variable displacement swash plate type compressor including a cylinder block having a plurality of cylinder bores, a drive shaft rotatably supported by the cylinder block, a lug plate fixedly installed at the drive shaft, a swash plate rotated by the lug plate to vary its inclination angle, and pistons reciprocally accommodated in the cylinder bores depending on rotation of the swash plate, the compressor including a projection projecting from the lug plate toward the swash plate and disposed only behind the rotational direction of the drive shaft, a slope formed on the rear part of the lug plate at one side of the projection, an arm projecting from the swash plate toward the lug plate, a first guide coupled to the arm in front of the rotational direction of the drive shaft to move along the slope in a contact manner, and a second guide coupled to the arm adjacent to the projection to move along the slope in a contact manner.

14 Claims, 10 Drawing Sheets

U.S. PATENT DOCUMENTS

| | | | | |
|---|---|---|---|---|
| 6,139,283 | A * | 10/2000 | Ahn | 417/222.2 |
| 6,402,481 | B1 * | 6/2002 | Ahn | 417/222.2 |
| 7,757,597 | B2 * | 7/2010 | Lee et al. | 92/12.2 |
| 7,771,175 | B2 * | 8/2010 | Ota et al. | 417/269 |

FOREIGN PATENT DOCUMENTS

| | | | |
|---|---|---|---|
| JP | 3416738 | | 6/2003 |
| JP | 2005-207287 | | 8/2005 |
| JP | 2006-291749 | | 10/2006 |
| JP | 2011-501027 | | 1/2011 |
| KR | 10-2001-0056586 | | 7/2001 |
| KR | 10-2004-0035487 | | 4/2004 |
| KR | 10-2006-0009067 | | 1/2006 |
| KR | 10-2006-0120155 | | 11/2006 |
| KR | 2009-0040131 | | 4/2009 |
| WO | WO 2006 085709 | * | 8/2006 |
| WO | WO/2009/051436 | | 4/2009 |

OTHER PUBLICATIONS

International Preliminary Report on Patentability issued by the International Bureau on Apr. 20, 2010 for PCT/KR2008/006140 filed on Oct. 17, 2008 and published as WO/2009/051436 on Apr. 23, 2009 (Applicants—Doowon Technical College, et al. // Inventors—Lee et al.) (5 pages).

International Search Report and Written Opinion mailed by the International Bureau on Feb. 10. 2009 for PCT/KR2008/006140 filed on Oct. 17, 2008 and published as WO/2009/051436 on Apr. 23, 2009 (Applicants—Doowon Technical College, et al. // Inventors—Lee et al.) (6 pages).

* cited by examiner

VARIABLE DISPLACEMENT SWASH PLATE TYPE COMPRESSOR

CROSS REFERENCE TO RELATED APPLICATIONS

The present application is a National Phase Application of International Application No. PCT/KR2008/006140 filed Oct. 17, 2008, which claims priority to Korean Patent Application No. 10-2007-0105762 filed Oct. 19, 2007, which applications are incorporated herein fully by this reference.

TECHNICAL FIELD

The present invention relates to a variable displacement swash plate type compressor, and more particularly, to a variable displacement swash plate type compressor capable of preventing distortion of the swash plate to smoothly change an inclination angle of the swash plate and preventing abnormal wearing of a power transmission member and a slope movement member to increase compression efficiency and reduce manufacturing cost.

BACKGROUND ART

Various kinds of compressors such as a scroll type or a swash plate type, are used in various fields using hydraulic pressure, for example, an air conditioning apparatus. In general, swash plate type compressors using an inclination angle of a swash plate and employing a plurality of cylinders have been widely used to more precisely perform hydraulic control.

Among them, a variable displacement swash plate type compressor capable of continuously varying an inclination angle of a swash plate depending on variation in thermal load to control strokes of pistons to thereby perform precise flow rate control and preventing abrupt variation in torque of an engine due to the compressor to improve ride comfort of a vehicle is being widely used.

In a conventional variable displacement swash plate type compressor, since a power transmission element fixed to a drive shaft and transmitting power from a rotating lug plate to a swash plate is separate from an element for slope movement of the swash plate, the lug plate may be in direct contact with the swash plate, thus rapidly wearing a compressor member and disturbing smooth slope movement of the swash plate.

Therefore, a swash plate type compressor in which a component for rotational power transmission and a component for slope movement guide are integrated as a single body has been proposed. For example, disclosed hereinafter is a variable displacement swash plate type compressor including slide blocks installed at both side ends of a pin passing through a projection projecting from a center part of a front surface of a swash plate such that the slide blocks perform the power transmission and the slope movement guide.

FIGS. 1 to 4 show an example of a conventional variable displacement swash plate type compressor disclosed in Korean Patent Application 10-2006-0120155, which will be briefly described with reference to the drawings.

FIG. 1 is a perspective view of a conventional variable displacement swash plate type compressor 10. A pin 41 is inserted into a projection 41 formed at a front center part of a swash plate 40 and slide blocks 43 are disposed on both sides of the pin. Peripheral surfaces of the slide blocks 43 roll along slopes 34 formed in a power transmission groove 31 of a lug plate 30 to enable slope movement of the swash plate 40. In addition, the both surfaces of the slide blocks 43 transmit rotational movement of the lug plate 30 by contacting with side surfaces 35 of the power transmission groove 31. That is, direct contact between the lug plate 30 and the swash plate 40 can be prevented by a rear groove 33 in a direction of a drive shaft 20 and the slide blocks 43 in a direction of the sidewalls 35 of the lug plate 30.

FIG. 2 is an exploded perspective view of the conventional variable displacement swash plate type compressor, showing components related to coupling the lug plate 30 and the swash plate 40 of the compressor 10. The sidewalls 35 of the power transmission groove 31 of the lug plate 30 are formed at front and rear sides in a rotational direction of the drive shaft 20. The power transmission groove 31 is constituted by two slopes 34 and a rear groove 33 disposed between the slopes 34. The slide blocks 43 installed at both sides of the projection 41 disposed at a front center of the swash plate 40 are rolled on the slopes 34 to vary an inclination angle of the swash plate 40. In addition, the rear groove 33 prevents direct contact between the lug plate 30 and the swash plate 40 to minimize wearing of members during power transmission and slope movement guide. Meanwhile, side grooves 32 are formed in the both sidewalls of the power transmission groove 31 to prevent the swash plate 40 from coming off due to insertion of a pin 42 into the grooves 32, when the swash plate 40 moves along the slope.

FIG. 3 is a perspective view showing a rear surface of the lug plate 30 of the conventional variable displacement swash plate type compressor. In addition to the description of FIG. 2, a reinforcement rib 36 connecting a rear surface of the sidewall 35 of the lug plate 30 to a rear surface of the lug plate 30 is configured to prevent deformation of the lug plate 30 due to rotational movement thereof. Inner surfaces 37 of the sidewalls 35 of the lug plate 30 contacts with the slide blocks 43 to transmit rotational movement of the lug plate 30 to the swash plate 40 through the slide blocks 43.

FIG. 4 is a perspective view showing a front surface of the swash plate 40 of the conventional variable displacement swash plate type compressor. In addition to the description of FIG. 2, an insertion hole 44 is formed in the swash plate 40. A sleeve inserted into the drive shaft through the insertion hole 44 is coupled to the swash plate 40 to prevent the swash plate 40 from being separated from the center of the drive shaft.

According to the conventional art, the side surfaces of the slide blocks perform power transmission and the peripheral surfaces of the slide blocks perform slope movement guide to prevent direct contact between the lug plate and the swash plate, thereby minimizing wearing of the members and facilitating slope movement of the swash plate.

DISCLOSURE OF INVENTION

Technical Problem

However, since a conventional variable displacement swash plate type compressor includes a plurality of cylinders in which coolant is sucked or discharged, a resultant force of pistons installed in the cylinders may not be aligned with a rotational center of the drive shaft. In this case, a cylinder block and a swash plate are distorted so that smooth slope movement of the swash plate, a major component of the swash plate type compressor, cannot be performed. In addition, abnormal wearing of a power transmission part is accelerated, thus decreasing compression efficiency and durability of components.

Therefore, an object of the present invention is to provide a variable displacement swash plate type compressor having a configuration capable of effectively preventing distortion of a swash plate.

Technical Solution

The foregoing and/or other objects of the present invention may be achieved by providing a variable displacement swash plate type compressor including a cylinder block having a plurality of cylinder bores, a drive shaft rotatably supported by the cylinder block, a lug plate fixedly installed at the drive shaft, a swash plate rotated by the lug plate to vary its inclination angle, and pistons reciprocally accommodated in the cylinder bores depending on rotation of the swash plate, the compressor including:

a projection projecting from the lug plate toward the swash plate and disposed only behind the rotational direction of the drive shaft;

a slope formed on the rear part of the lug plate at one side of the projection:

an arm projecting from the swash plate toward the lug plate;

a first guide coupled to the arm in front of the rotational direction of the drive shaft to move along the slope; and a second guide coupled to the arm adjacent to the projection to move along the slope. The second guide may have at least one contact surface contacted with the projection.

The slope may include a first slope opposing the first guide and a second slope opposing the second guide, and the first slope and the second slope may be spaced apart from each other by a predetermined distance.

The first guide and the second guide may move along the slope in a contact manner.

The contact area of the first guide may be larger than the contact area of the second guide.

The slope may include a first slope along which the first guide moves in a contact manner and a second slope along which the second guide moves in a contact manner, and the first slope and the second slope may be spaced apart from each other by a predetermined distance.

The slope may have a rear groove and an end of the arm may be inserted into the rear groove.

The first guide and the second guide may be coupled to the arm via a pin passing through the arm.

Through-holes through which the pin passes may be formed in the first guide and the second guide respectively.

The projection may have a side groove formed in its inner surface, and one end of the pin may be inserted into the side groove.

The projection may have a side groove formed in its inner surface, and the side groove, the slope, and the rear groove may be formed sequentially in the direction of the drive shaft.

The first guide and the second guide may have circular cross-sections.

The first guide and the second guide may have polygonal cross-sections.

The first guide and the second guide may roll on the slope.

When seen from the drive shaft, a tip of the first guide may be farther from a line connecting from a center of the cylinder block to a center of the arm than that of the second guide.

When seen from the drive shaft, a distance (L) from the tip of the first guide to the line connecting from the center of the cylinder block to the center of the arm may be 0.4 times or more a radius (R) of a circle formed by centers of the plurality of cylinder bores.

BRIEF DESCRIPTION OF DRAWINGS

The above and other aspects and advantages of the present invention will become apparent and more readily appreciated from the following description of exemplary embodiments, taken in conjunction with the accompanying drawings, in which.

MODE FOR THE INVENTION

Reference will now be made in detail to a variable displacement swash plate type compressor in accordance with an exemplary embodiment of the present invention illustrated in the accompanying drawings in comparison with a conventional art.

FIGS. 5 to 10 show the variable displacement swash plate type compressor in accordance with an exemplary embodiment of the present invention.

Figure 1:
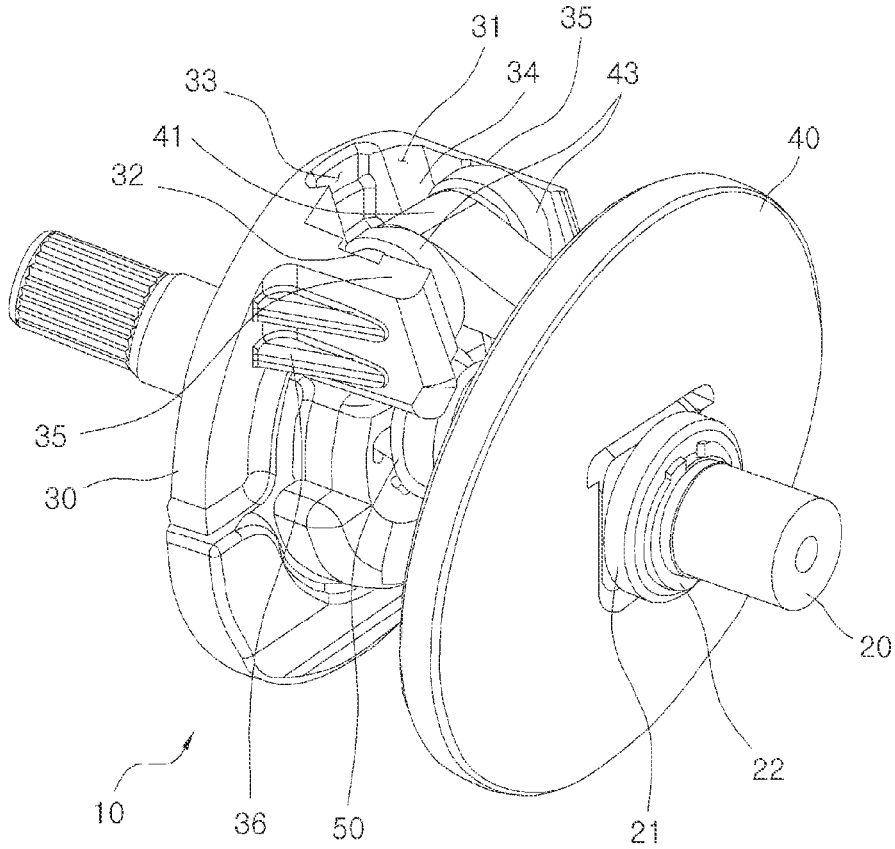
FIG. 1 is a perspective view of a conventional swash plate type compressor.
Figure 2:
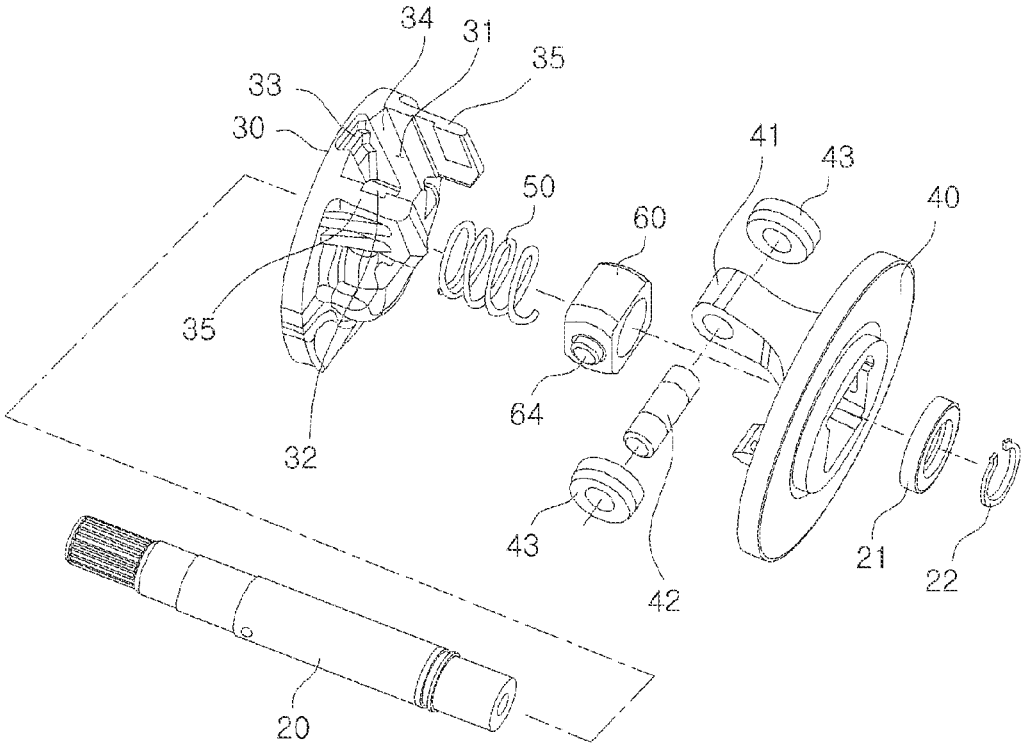
FIG. 2 is an exploded perspective view of the conventional swash plate type compressor.
Figure 3:
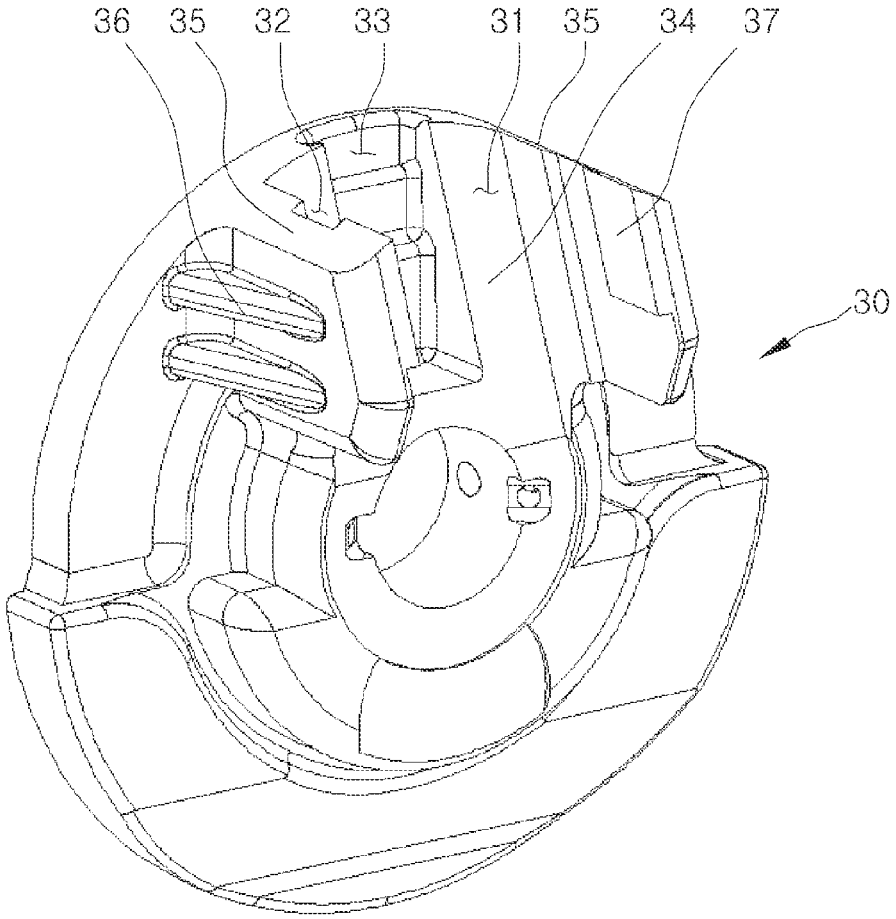
FIG. 3 is an enlarged view of a rear surface of a lug plate of the conventional swash plate type compressor.
Figure 4:
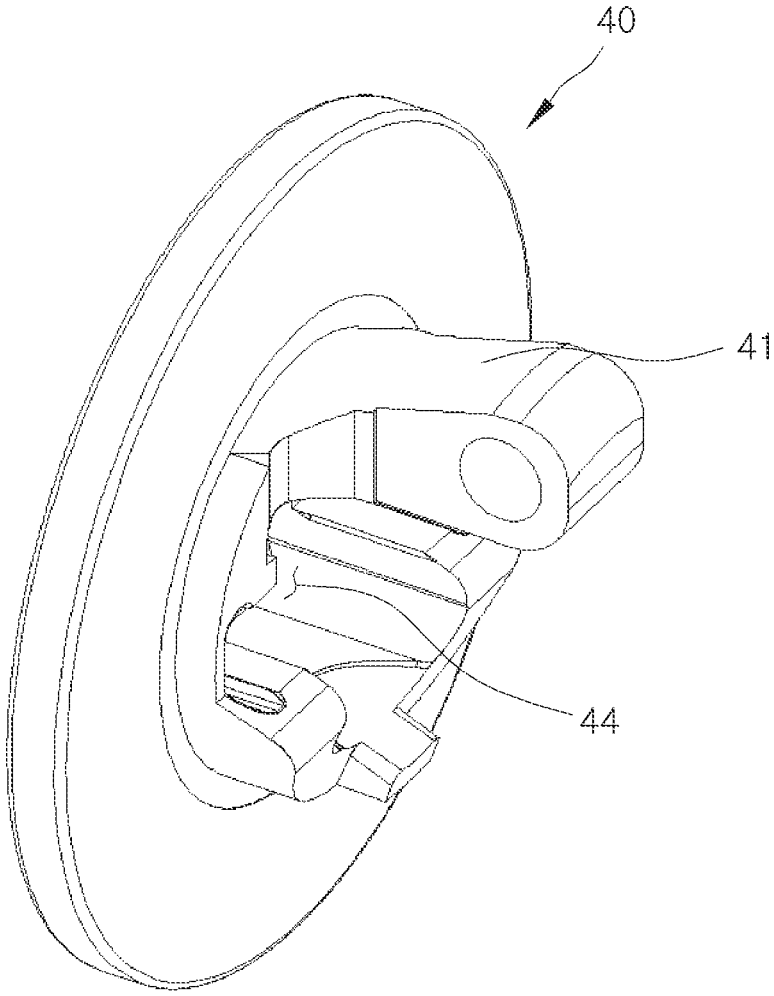
FIG. 4 is an enlarged view of a front surface of a swash plate of the conventional swash plate type compressor.
Figure 5:
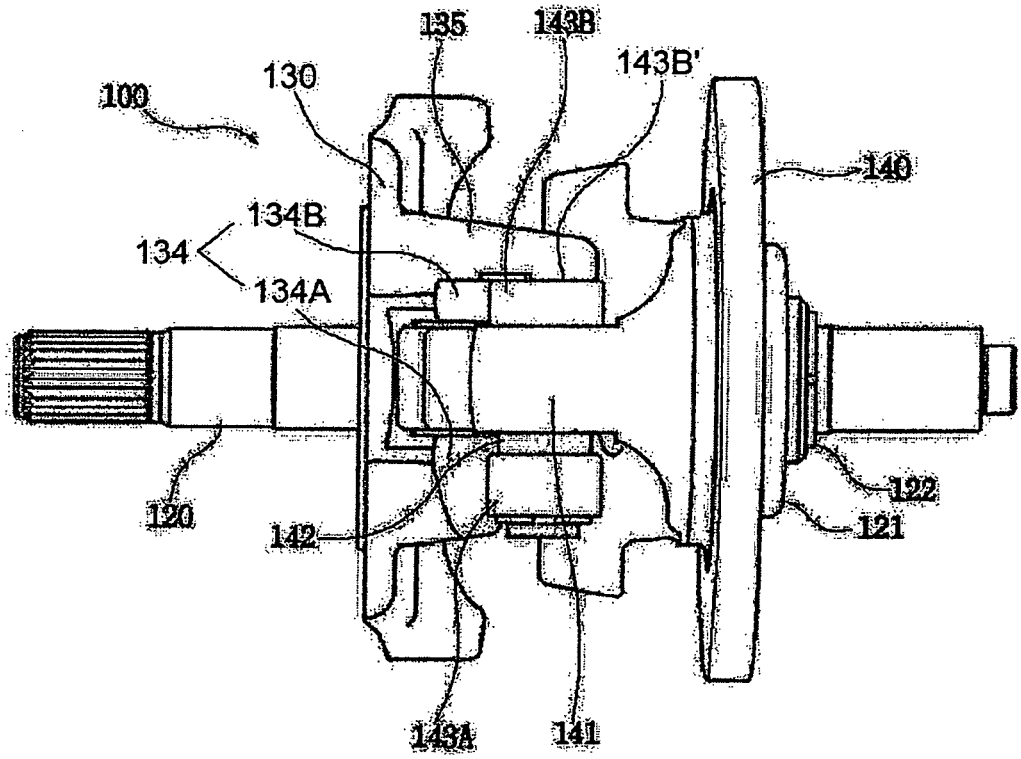
FIG. 5 is a plan view of a swash plate type compressor in accordance with an exemplary embodiment of the present invention.

FIG. 5 is a plan view of the variable displacement swash plate type compressor 100 in accordance with an exemplary embodiment of the present invention. A first guide 143A and a second guide 143B are installed at both side ends of a pin 142 inserted in a vertical direction of an arm 141 projecting from a front center of a swash plate 140 toward a lug plate 130. For example, the guide located in front of a rotational direction of the drive shaft 120 is referred to as the first guide 143A, and the guide located behind the rotational direction of the drive shaft 120 is referred to as the second guide 143B. Meanwhile, the pin 142 may pass through the center of the arm 141 or may be fastened to the arm 141 by welding, etc.

Figure 10:
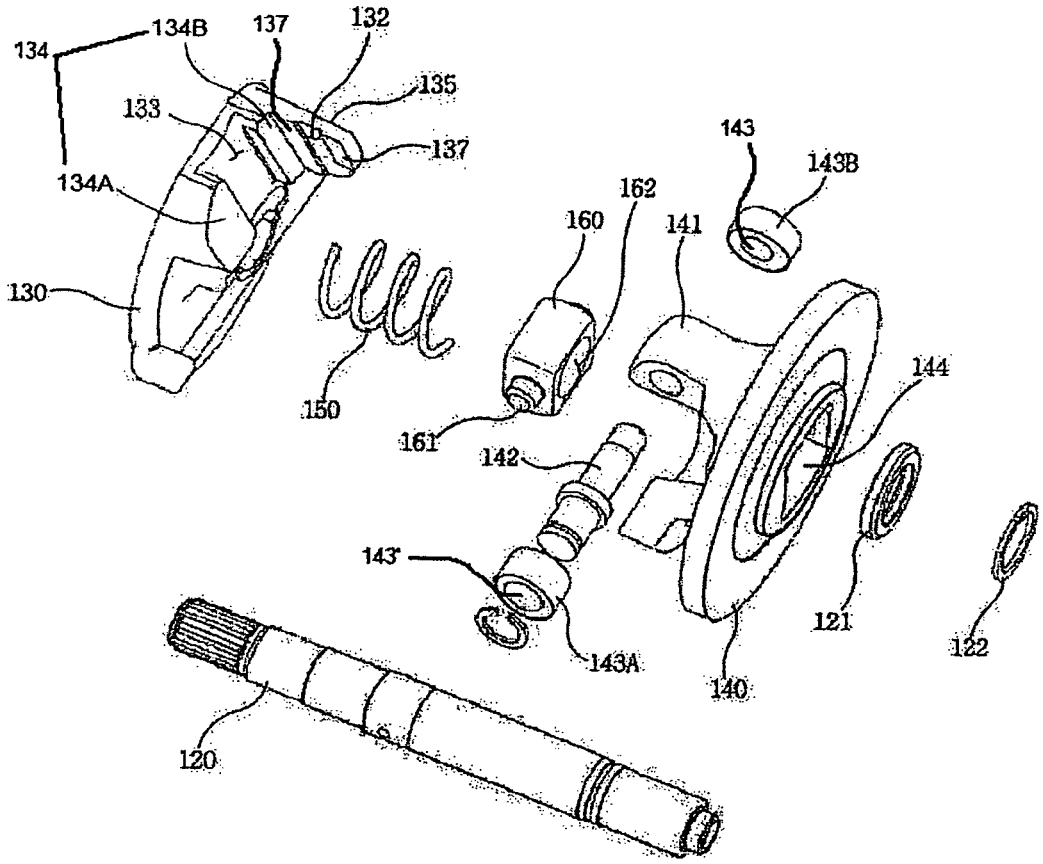
FIG. 10 is an exploded perspective view of the swash plate type compressor in accordance with an exemplary embodiment of the present invention.

As illustrated in FIG. 10, through-holes 143' through which the pin 142 passes are formed in the first guide 143A and the second guide 143B respectively.

Here, the first guide 143A and the second guide 143B preferably have circular cross-sections to be easily rolled, but the present invention is not limited thereto. That is, the first guide 143A and the second guide 143B may have polygonal cross-sections to effectively transmit the inclined movement of the swash plate 140 through rolling contact or surface contact thereof.

At least one contact surface 143B' contacted with the projection 135 of the lug plate 130 is formed in the second guide 143B located behind the rotational direction of the drive shaft 120 to easily transmit the rotation of the lug plate 130 fixed to the drive shaft 120 to the swash plate 140.

That is, since while a projection 135 facing the swash plate 140 is formed behind the rotational direction of the drive shaft 120 of the lug plate, there is no projection formed in front of rotational direction of the lug plate 130, as there is behind the rotational direction, the first guide 143A located in front of the rotational direction of the drive shaft 120 does not transmit the rotational power to the swash plate 140. Since a position of the first guide 143A is not limited by the projection, the first guide 143A can be installed anywhere within a range of the length of the pin 142. This means that the position of the first guide 143A can be set depending on a position at which a resultant force of a plurality of pistons is actually applied departing from a center of the drive shaft 120.

Meanwhile, the rear part of the lug plate 130 has a slope 134 at one side of the projection 135, and the slope 134 includes a first slope 134A opposing the first guide 143A and a second slope 134B opposing the second guide 143B, and the first slope 134A and the second slope 134B are spaced apart from each other by a predetermined distance.

The first guide 143A and the second guide 143B roll or move in a contact manner along the slope 134 to guide the inclined movement of the swash plate 140.

Moreover, since the contact area of the first guide 143A contacted with the slope 134 is larger than the contact area of the second guide 143B, they enable stable guide and support. Here, it is apparent that the area of the first slope 134A corresponding to the first guide 143A is larger than the area of the slope 134B corresponding to the second guide 143B.

A stopper 121 and a snap ring 122 disposed at a rear surface of the swash plate 140 function to stop movement of a sleeve and the swash plate 140 when rotation of the drive shaft 120 is stopped.

Figure 6:
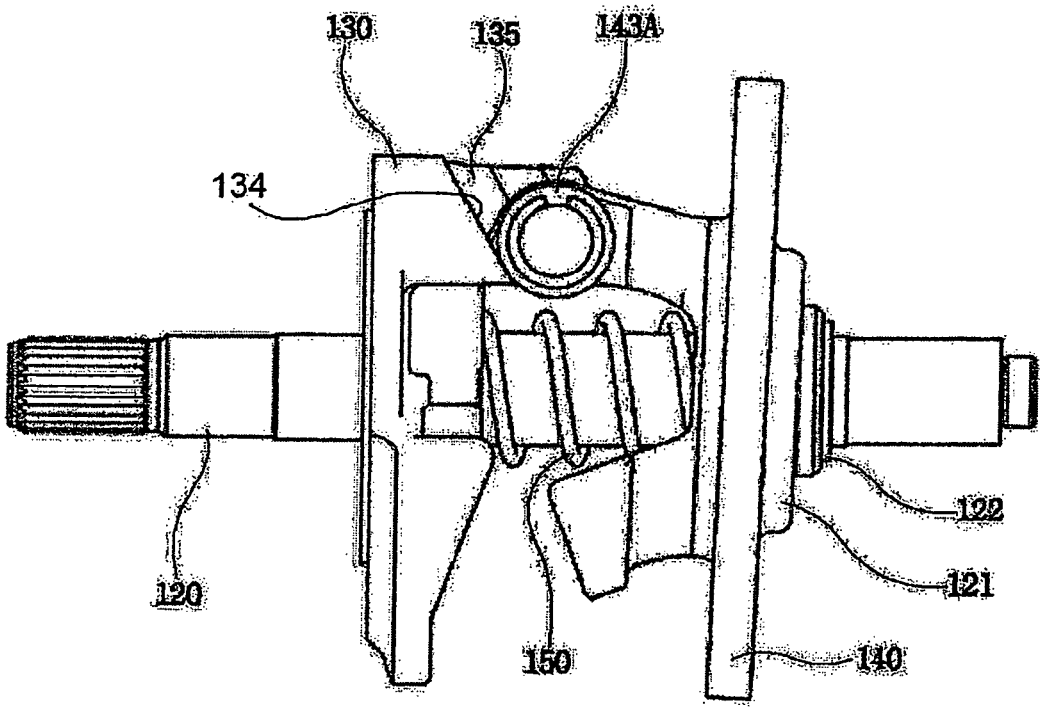
FIG. 6 is a front view of the swash plate type compressor in accordance with an exemplary embodiment of the present invention.

FIG. 6 is a front view of the variable displacement swash plate type compressor in accordance with an exemplary embodiment of the present invention. In addition to the description of FIG. 5, a spring 150 is axially installed from a rear surface of the lug plate 130 to the swash plate 140. When the spring 150 is slackened, the swash plate 140 has a minimum inclination angle. When the spring 150 is compressed due to a pressure difference between a swash plate chamber and the cylinder bore, an inclination angle of the swash plate 140 is determined by the pressure difference. That is, when the pressure difference between the swash plate chamber and the cylinder bore is maximized, the inclination angle of the swash plate 140 also arrives at a maximum value, and the swash plate 140 is inclined until a lower part of the swash plate 140 is in contact with the lug plate 130.

Figure 7:
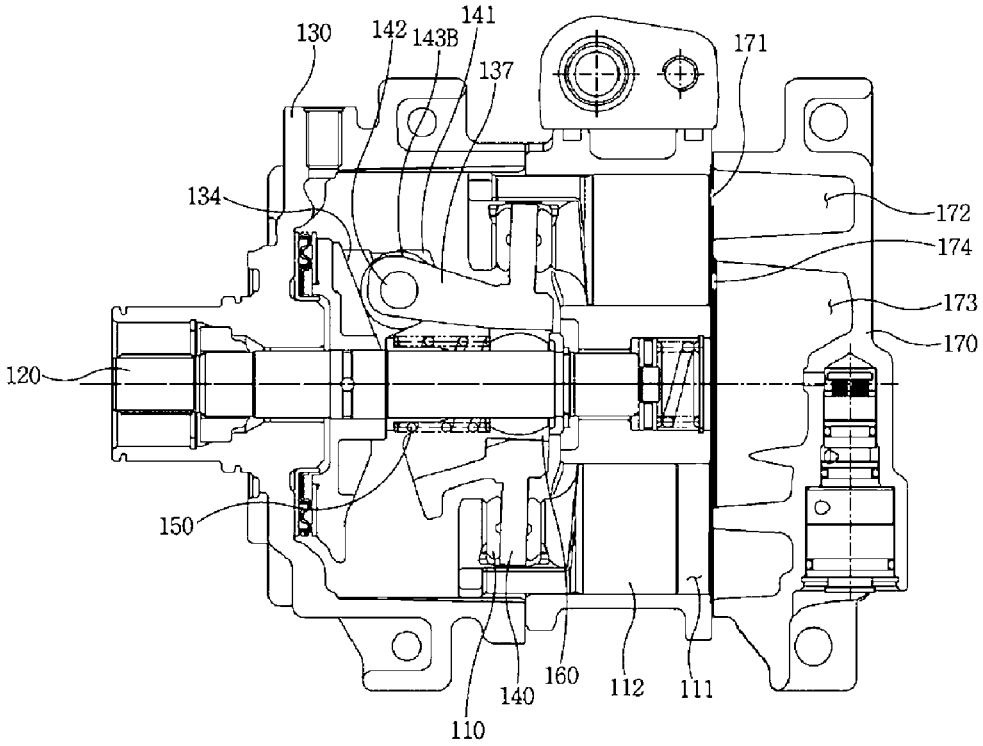
FIG. 7 is a transverse cross-sectional view of the swash plate type compressor in accordance with an exemplary embodiment of the present invention.

FIG. 7 is a transverse cross-sectional view of the variable displacement swash plate type compressor in accordance with an exemplary embodiment of the present invention.

Pistons 112 are installed in cylinder bores 111 via shoes 110 connected to the swash plate 140 such that the pistons 112 reciprocate in the cylinder bores 111 in a lateral direction along the slope of the swash plate 140 to repeatedly suck and discharge coolant. At this time, the coolant is supplied from a suction chamber 172 installed in a rear housing 170 of the variable displacement swash plate type compressor into the cylinder bores 111 through a suction port 171. Similarly, the coolant is discharged from the cylinder bores 111 to a discharge chamber 173 installed in the rear housing 170 through a discharge port 174.

Figure 8:
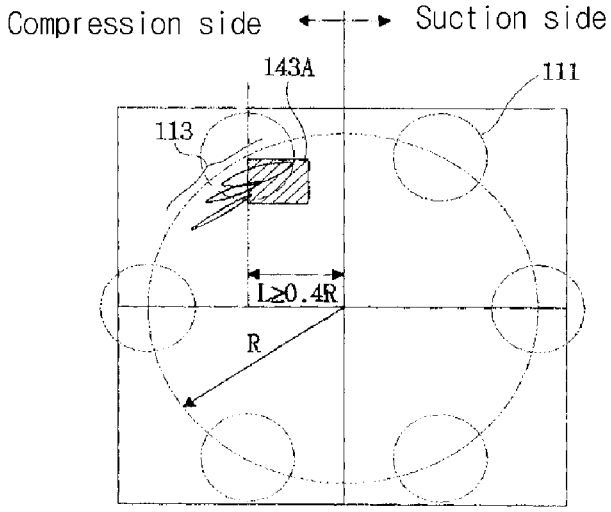
FIG. 8 is a side cross-sectional view showing a position of a first guide of the swash plate type compressor in accordance with an exemplary embodiment of the present invention.

FIG. 8 is a side cross-sectional view showing a position of the first guide 143A of the variable displacement swash plate type compressor in accordance with an exemplary embodiment of the present invention. When seen from a longitudinal direction of the drive shaft, the plurality of cylinder bores 111 are disposed in a peripheral direction of a cylinder block at predetermined angular intervals. At this time, a resultant force of the pistons actually applied to the cylinder bores 111 is typically located at a position 113 adjacent to a compression side, not a center of the cylinder block. Therefore, as described in FIG. 5, when the position of the first guide 143A is located to correspond to the position 113 where the resultant force of the pistons is applied, it is possible to prevent distortion of the swash plate which may generated due to misalignment of the position 113 where the resultant force of the pistons is applied and the center of the cylinder block. Here, a distance L from a line connecting the center of the cylinder block and the center of the arm to a position where a tip of the first guide 143A is located may be 0.4 times or more a radius R of a circle formed of centers of the cylinder bores 111 to stably support a load and smoothly guide the guide along the slope 134.

In addition, when seen from the drive shaft, a tip of the first guide 143A may be farther from the line connecting the center of the cylinder block and the center of the arm 141 than a tip of the second guide 143B.

Since the slope before the rotational direction about a rear groove 133 may have a larger width, the width of the first guide 143A corresponding thereto may be increased to accomplish stable guidance and support functions.

Meanwhile, an end of the first guide 143A is spaced apart from the inner surface of the front housing 177 to avoid interference.

Figure 9:
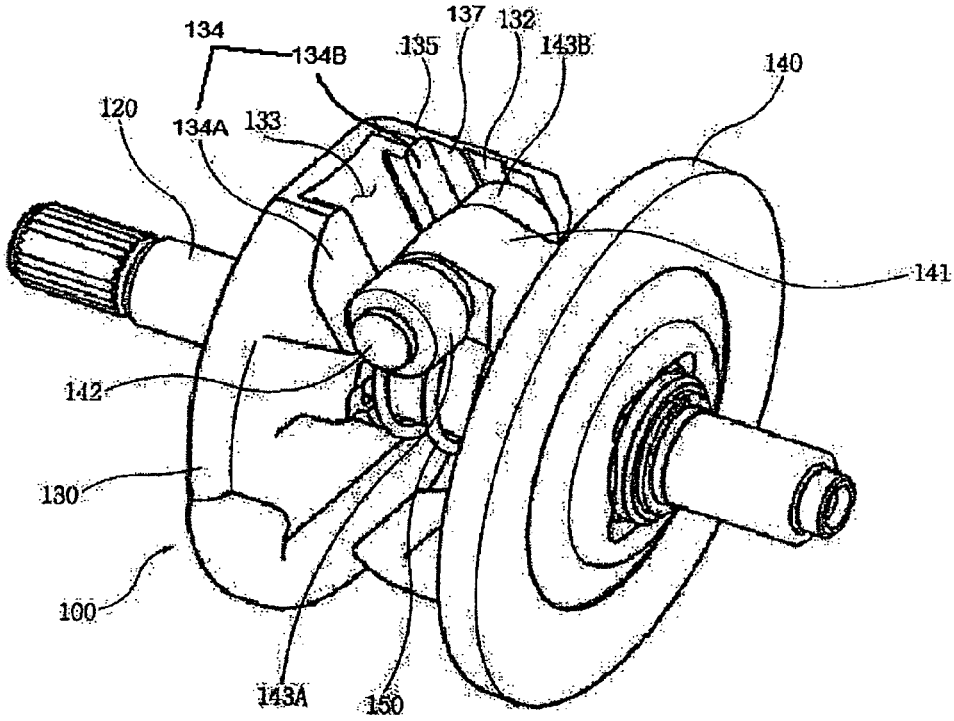
FIG. 9 is a perspective view of the swash plate type compressor in accordance with an exemplary embodiment of the present invention.

FIG. 9 is a perspective view of the variable displacement swash plate type compressor in accordance with an exemplary embodiment of the present invention. The first guide 143A and the second guide 143B roll along the slope 134 formed at the rear surface of the lug plate 130 to move the swash plate 140 in a slant direction, and the side surfaces of the second guide 143B transmit power (rotational movement) of the lug plate 130 to the swash plate 140 through a power transmission surface 137 formed at an inner sidewall of the projection 135.

In addition, a rear groove 133 is formed in a bottom center of the slope 134, and an end of the arm 141 is inserted into the rear groove 133 to be hooked thereinto upon reverse rotation of the lug plate 130, thereby preventing the lug plate 130 from loosening.

In particular, the slope 134 by the side of the projection 135 is formed adjacent to the inner surface of the projection 135 in the vicinity of the rear surface 133.

A side groove 132 recessed inward from the power transmission surface 137 is formed on the inner surface of the projection 135.

As a whole, the rear groove 133, the second slope 134B, the power transmission surface 137, the side groove 132, and the power transmission surface 137 are sequentially formed in the projection 135. Therefore, power transmission to the swash plate 140 and guidance of the swash plate 140 can be simultaneously performed by the power transmission surface 137 formed at the inner surface of the projection 135 and the second slope 134B adjacent to the power transmission surface 137.

In addition, one end of the pin 142 is inserted into the side groove 132. Since the pin 142 is inserted into the side groove 132, it is possible to prevent the swash plate 140 from being pushed toward the piston upon initial movement or stop of the compressor when a gas pressure is not properly applied.

FIG. 10 is an exploded perspective view of the variable displacement swash plate type compressor in accordance with an exemplary embodiment of the present invention. In addition to the description of FIGS. 5 to 9, it will be appreciated that the swash plate 140 includes a sleeve 160 for smoothly moving the swash plate 140 along the drive shaft 120. The sleeve 160 has a coupling hole 162 formed at its center such that the sleeve 120 can move along the drive shaft 120 in a longitudinal direction thereof, and guide projections 161 are formed at both sides about the coupling hole 162. A guide groove (not shown) is formed in an inner surface of the insertion groove 144 of the swash plate 140 to be readily coupled to the guide projections 161 of the sleeve 160. The sleeve 160 connected to one end of the spring 150 moves toward the lug plate 130 along the drive shaft 120 depending on contraction of the spring 150 to tilt the swash plate 140. When the spring 150 is slackened, the sleeve 160 moves toward the swash plate 140 along the drive shaft 120 to stand the swash plate 140 in an upright position.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

INDUSTRIAL APPLICABILITY

As can be seen from the foregoing, a variable displacement swash plate type compressor in accordance with an exemplary embodiment of the present invention can prevent distortion of a swash plate, which may be caused due to offset of the center of gravity of the swash plate toward a compression-side cylinder. Prevention of distortion of the swash plate means smooth slope movement of the swash plate and prevention of abnormal wearing of related members such as a projection and guides. In addition, the projection is formed only behind a rotational direction of a drive shaft to transmit rotational movement of the lug plate, thereby reducing manufacturing cost through the light-weighted compressor.

Moreover, since there is no projection in front of the rotational direction, position of a first guide can be varied without limitation due to the projection. As a result, the position of the first guide can be flexibly set depending on actual compression conditions, in which a resultant force of pistons is applied, to prevent abnormal wearing of members and remarkably improve durability of the compressor.

The invention claimed is:

1. A variable displacement swash plate type compressor including:

a cylinder block having a plurality of cylinder bores;

a drive shaft rotatably supported by the cylinder block;

a lug plate fixedly installed at the drive shaft;

a swash plate rotated by the lug plate to vary its inclination angle; and pistons reciprocally accommodated in the cylinder bores depending on rotation of the swash plate, the compressor comprising:

a projection projecting from the lug plate toward the swash plate and disposed only behind the rotational direction of the drive shaft;

a slope formed on the rear part of the lug plate at one side of the projection;

an arm projecting from the swash plate toward the lug plate;

a first guide coupled to the arm in front of the rotational direction of the drive shaft to move along the slope; and a second guide coupled to the arm adjacent to the projection to move along the slope;

wherein the first guide and the second guide are coupled to the arm via a pin passing through the arm, wherein the projection has a side groove formed in its inner surface, the pin extends past the second guide, and one end of the pin is inserted into the side groove and directly guided by the side groove.

2. The variable displacement swash plate type compressor according to claim 1, wherein the second guide has at least one contact surface contacted with the projection.

3. The variable displacement swash plate type compressor according to claim 1, wherein the slope includes a first slope opposing the first guide and a second slope opposing the second guide, and the first slope and the second slope are spaced apart from each other by a predetermined distance.

4. The variable displacement swash plate type compressor according to claim 1, wherein the first guide and the second guide move along the slope in a contact manner.

5. The variable displacement swash plate type compressor according to claim 4, wherein the first guide has at least one contact surface contacted with the projection, and wherein the contact area of the first guide is larger than the contact area of the second guide.

6. The variable displacement swash plate type compressor according to claim 4, wherein the slope includes a first slope along which the first guide moves in a contact manner and a second slope along which the second guide moves in a contact manner, and the first slope and the second slope are spaced apart from each other by a predetermined distance.

7. The variable displacement swash plate type compressor according to claim 1, wherein the slope has a rear groove and an end of the arm is inserted into the rear groove.

8. The variable displacement swash plate type compressor according to claim 1, wherein through-holes through which the pin passes are formed in the first guide and the second guide respectively.

9. The variable displacement swash plate type compressor according to claim 7, wherein the projection has a side groove formed in its inner surface, and the side groove, the slope, and the rear groove are formed sequentially in the direction of the drive shaft.

10. The variable displacement swash plate type compressor according to claim 1, wherein the first guide and the second guide have circular cross-sections.

11. The variable displacement swash plate type compressor according to claim 1, wherein the first guide and the second guide have polygonal cross-sections.

12. The variable displacement swash plate type compressor according to claim 1, wherein the first guide and the second guide roll on the slope.

13. The variable displacement swash plate type compressor according to claim 1, wherein, when seen from the drive shaft, a tip of the first guide is farther from a line connecting from a center of the cylinder block to a center of the arm than that of the second guide.

14. The variable displacement swash plate type compressor according to claim 1, wherein, when seen from the drive shaft, a distance (L) from the tip of the first guide to the line connecting from the center of the cylinder block to the center of the arm is 0.4 times or more a radius (R) of a circle formed by centers of the plurality of cylinder bores.

* * * * *

UNITED STATES PATENT AND TRADEMARK OFFICE

CERTIFICATE OF CORRECTION

PATENT NO. : 8,459,962 B2
APPLICATION NO. : 12/738745
DATED : June 11, 2013
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 387 days.

Signed and Sealed this
Eighth Day of September, 2015

Michelle K. Lee

Michelle K. Lee
*Director of the United States Patent and Trademark Office*